US005096621A

United States Patent [19]

Tosaka et al.

[11] Patent Number: 5,096,621

[45] Date of Patent: Mar. 17, 1992

[54] DETERGENT COMPOSITION CONTAINING DI-LONG CHAIN ALKYL AMINE OXIDES

[75] Inventors: Masaki Tosaka; Yasuyuki Fujii; Noriyuki Morii; Katsuhiko Deguchi, all of Tochigi, Japan

[73] Assignee: Kao Corporation, Tokyo, Japan

[21] Appl. No.: 505,480

[22] Filed: Apr. 6, 1990

[30] Foreign Application Priority Data

Apr. 19, 1989 [JP] Japan ..... 1-99496
Apr. 19, 1989 [JP] Japan ..... 1-99497

[51] Int. Cl.[5] ..... C11D 3/30; C11D 7/32

[52] U.S. Cl. ..... 252/547; 252/528; 252/550; 252/174.21

[58] Field of Search ..... 252/547, 528, 550, 552, 252/553, 174.21

[56] References Cited

U.S. PATENT DOCUMENTS

| | | | |
|---|---|---|---|
| 3,223,647 | 12/1965 | Drew et al. | 252/137 |
| 3,281,368 | 10/1966 | Zimmerer et al. | 252/137 |
| 3,317,430 | 5/1967 | Priestley et al. | 252/152 |
| 3,351,557 | 11/1967 | Almstead et al. | 252/106 |
| 3,501,335 | 3/1970 | Cahn et al. | 117/66 |
| 3,668,153 | 6/1972 | Crotty | 252/528 |
| 4,014,800 | 3/1977 | Kleber | 252/8.8 |
| 4,026,825 | 5/1977 | Steen et al. | 252/547 |
| 4,247,424 | 1/1981 | Kuzel et al. | 252/528 |
| 4,276,205 | 6/1981 | Ferry | 252/528 |
| 4,359,413 | 11/1982 | Ward et al. | 252/527 |
| 4,681,704 | 6/1987 | Bernardino et al. | 252/546 |
| 4,921,627 | 5/1990 | Copeland et al. | 252/99 |

FOREIGN PATENT DOCUMENTS 0267662 5/1988 European Pat. Off. .

OTHER PUBLICATIONS

European Search Report.

*Primary Examiner*—A. Lionel Clingman
*Assistant Examiner*—Erin M. Higgins
*Attorney, Agent, or Firm*—Birch, Stewart, Kolasch & Birch

[57] ABSTRACT

A detergent composition comprises (a) an anionic or nonionic surfactant and (b) a dialkylamine oxide having the formula (I), a weight ratio of (a) to (b) ranging from 0.01 to 100, (I)

in which R1 and R2 each are an alkyl having 6 to 18 carbon atoms, an alkenyl having 6 to 18 carbon atoms, R3 is ethylene, isopropylene, n-propylene or a mixture thereof, R4 is an alkyl having 1 to 4 carbon atoms, a hydroxy alkyl having 1 to 4 carbon atoms, benzyl or hydrogen and n is a number of 1 to 20.

6 Claims, 1 Drawing Sheet

DETERGENT COMPOSITION CONTAINING DI-LONG CHAIN ALKYL AMINE OXIDES

The invention relates to a detergent composition comprising an anionic or nonionic surfactant and a specific dialkyl amine oxide which has, excellent permeability and excellent detergent power.

PRIOR ART

As the basic nature of surface active agents, there can be mentioned emulsifying effect, solubilizing effect, dispersing effect, foaming effect, permeating effect, etc. In the case of using a surface active agent as one of the ingredients in a detergent, it is considered that the detergent power is developed as an overall effect of these effects.

Among the above-mentioned effects, it is considered that the permeability facilitates, for example, the wetting of textiles with the liquid detergent upon washing textiles, thereby causing the detergent ingredients to act easily on the contaminations deposited between fibers. Further, it is considered that this improves the wettability of articles to be cleaned upon cleaning the hard surface of tablewares. cooking appliances, etc. to allow for the easy removing of greasy contaminations as well as has an effect of suppressing redepositing of the contaminations to the articles to be cleaned.

As a surface active agent having high permeability, the sodium salt of sulfosuccinic acid di-2-ethylhexyl ester (trade name: Aerosol OT) is well known. However, since the sodium salt of sulfosuccinic acid di-2-ethylhexyl ester easily suffers from the effect of hard ingredients in water used and forms less water soluble Ca and Mg salts in water at high hardness, no strong permeability effect can be developed. Further, since ester bondings are present in the molecules, there is a problem of poor alkali resistance and it has a risk of decomposition if used together with an alkali builder usually employed for heavy detergent for clothes. Further, when it is used for liquid detergents such as tableware detergent, since water solubility is low and liquid crystals are easily formed, it has a drawback that a liquid composition at high concentration can not be obtained with easy. Accordingly, it can not be used as a detergent base agent although contribution of the intense permeability to the detergent power is expected.

SUMMARY OF THE INVENTION

In view of the above-mentioned situations, the present inventors have made an earnest study for developing a detergent base agent of excellent permeability and have accomplished the present invention based on the finding that a specific kind of alkylamine oxide has a strong permeability comparable with that of sodium salt of sulfosuccinic acid di-2-ethylhexyl ester of and shows a satisfactory detergent power in combination with an anionic or nonionic surface active agent.

The detergent composition of the invention comprises (a) an anionic or nonionic surfactant and (b) a dialkylamine oxide having the formula (I), a weight ratio of (a) to (b) ranging from 0.01 to 100,

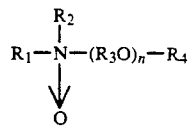

(I)

in which R1 and R2 each are an alkyl having 6 to 18 carbon atoms, an alkenyl having 6 to 18 carbon atoms, R3 is ethylene, isopropylene, n-propylene or a mixture thereof, R4 is an alkyl having 1 to 4 carbon atoms, a hydroxy alkyl having 1 to 4 carbon atoms, benzyl or hydrogen and n is a number of 1 to 20.

It is preferable that (a) is an anionic surfactant selected from the group consisting of an alkyl sulfate, a polyoxyalkylene alkyl ether sulfate, an alkyl benzene sulfonate, an alpha-sulfo-fatty acid ester salt, an alpha-olefin sulfonate and an alkane sulfonate.

The component (a) is preferably a nonionic surfactant selected from the group consisting of a polyoxyalkylenealkylether, a polyoxyalkylenealkylphenylether, a higher fatty acid alkanolamide, an alkylglycoside and a polyethylene oxide adduct of polypropyleneglycol.

The composition of the invention may be in the form of liquid, paste, solid or powder.

The composition may further comprise an amphoteric surfactant. It may further comprise a solubilizing agent, a builder, a water-softener, an alkali or a re-contamination inhibitor.

That is, the present invention provides a detergent composition (a) an anionic surface active agent and (b) a dialkylamine oxide represented by the following general formula (I), in which the weight ratio (a)/(b) of the ingredient (a) to the ingredient (b) is from 0.01 to 100:

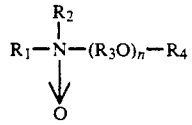

(I)

where $R_1$ and $R_2$ each represents an alkyl group or alkenyl group with 6 to 18 carbon atoms, $R_3$ represents $-CH_2CH_2-$, $-CH_2CH(CH)_3-$, $-CH_2CH_2CH_2-$ or a mixture thereof, $R_4$ represents an alkyl group or hydroxy alkyl group with 1 to 4 carbon atoms, benzyl group or hydrogen atom and n represents a number of 1 to 20.

Any anionic surface active agent may be used as the ingredient (a) in the present invention so long as it has a satisfactory compatibility with the ingredient (b), economical merit, etc. and there is no particular restriction thereto. Preferred examples as the ingredient (a) are shown below.

(1) Polyoxyalkylene alkyl ether sulfate or alkyl sulfate represented by the general formula (II):

$$R_5O(R_3O)_mSO_3M \quad \text{(II)}$$

where $R_5$ represents an alkyl or alkenyl group with 10 to 18 carbon atoms, $R_3$ represents the same meanings as those in the general formula (I) above, m represents a number of 0 to 7 and M represents an alkali metal, alkaline earth metal, ammonium or alkanol amine.

(2) An alkylbenzene sulfonate represented by the general formula (III):

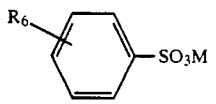

(III)

where $R_6$ represents an alkyl or alkenyl group with 8 to 18 carbon atoms and M has the same meanings as those in the general formula (II) described above.

(3) An α-sulfo fatty acid ester salt represented by the general formula (IV):

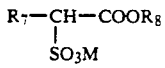

(IV)

where $R_7$ represents an alkyl or alkenyl group with 8 to 18 carbon atoms, $R_8$ represents an alkyl group with 1 to 3 carbon atoms, and M have the same meanings as those in the general formula (II) described above.

(4) An α-olefin sulfonate with 10 to 18 carbon atoms.

As the salts, there can be mentioned alkali metal salt, alkaline earth metal salt, ammonium salt, alkanolamine salt, etc.

(5) An alkane sulfonate with 10 to 18 carbon atoms.

As the salt, there can be mentioned alkali metal salt, alkaline earth metal salt, ammonium salt, alkanolamine salt, etc.

Accordingly, the present invention provides a detergent composition characterized by comprising:

(a) a nonionic surfactant, and (b) a dialkylamine oxide represented by the following general formula (I), the weight ratio of said component (a) to said component (b) being 0.01 to 100:

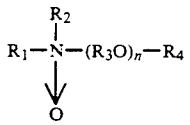

(I)

There is no particular limitation on the nonionic surfactant to be used as component (a) in the present invention, and any nonionic surfactant may be used as far as it is excellent in compatibility with component (b), profitability, etc. Preferred examples of component (a) will now be described.

(1) A polyoxyalkylene alkylphenyl ether represented by the general formula (II):

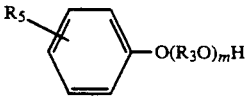

(II)

wherein $R_5$ is an alkyl or alkenyl group having 10 to 18 carbon atoms, $R_3$ is as defined above in connection with the general formula (I) and m is 3 to 40.

(2) A polyoxyalkylene alkyl ether represented by the general formula (III):

$$R_6O(R_3O)_mH \quad \text{(III)}$$

wherein $R_6$ is an alkyl or alkenyl group having 10 to 18 carbon atoms, $R_3$ is as defined above in connection with the general formula (I) and m is 3 to 40.

(3) A higher fatty acid alkanolamide represented by the general formula (IV) or (V):

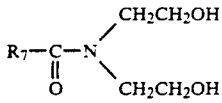

(IV)

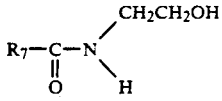

(V)

wherein $R_7$ is an alkyl or alkenyl group having 7 to 23 carbon atoms.

(4) An alkyl glycoside represented by the general formula (VI):

$$R_8(OR_9)_xG_y \quad \text{(VI)}$$

wherein $R_8$ is a straight-chain or branched alkyl, alkenyl or alkylphenyl group having 8 to 18 carbon atoms, $R_9$ is an alkylene group having 2 to 4 carbon atoms, G is a residue derived from a reducing sugar, x is 0 to 5, preferably 0 to 2 on the average, y is 1 to 10, preferably 1.1 to 3 on the average. Examples of the reducing sugar having 5 to 6 carbon atoms include glucose, galactose, xylose, mannose, lyxose, arabinose, maltose, xylobiose, isomaltose, cellobiose, gentiobiose, lactose, sucrose, nigerose, turanose, raffinose, gentianose and melezitose.

(5) A polypropylene glycol-polyethylene oxide adduct wherein the molecular weight of polypropylene glycol is 1000 to 4000 and the average molar number of addition of polyethylene oxide is 10 to 60.

(6) A polyoxyalkylene derivative prepared by reacting an alkylene oxide adduct of a monohydric alcohol, an alkylphenol or a monovalent mercaptan with a diepoxide compound.

Examples of the monohydric alcohol, alkylphenol or monovalent mercaptan (hereinafter referred to as the "compound A") as a starting material of the polyoxyalkylene derivative include those represented by the following general formulae (II) to (IV):

$$R_5—O—R_6H \quad \text{(II)}$$

wherein $R_5$ is an alkyl or alkenyl group having 10 to 24 carbon atoms and $R_6$ is a group formed by bonding at least 20 on the average of one or more members in any combination selected from among $—CH_2CH_2—O—$, $—CH_2CH_2CH_2—O—$ and $—CH_2CH(CH_3)—O—$

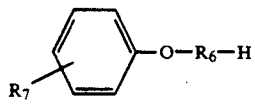

(III)

wherein $R_7$ is an alkyl or alkenyl group having 4 to 18 carbon atoms and $R_6$ is as defined above, and $$R_5—S—R_6—H \quad \text{(IV)}$$

wherein $R_5$ and $R_6$ are as defined above.

Compound A is prepared by adding in random or block form ethylene oxide, propylene oxide, etc. alone or in the form of a mixture thereof to a monohydric alcohol, an alkylphenol or a monovalent mercaptan according to an ordinary method.

The total number of carbon atoms of the monohydric alcohol, alkylphenol or monovalent mercaptan is preferably 10 to 24, particularly preferably 12 to 18.

$R_6$ in these compounds A is a group formed by bonding at least 20 on the average of one or more members in any combination selected from among $—CH_2CH_2—O—$, $—CH_2CH_2CH_2—O—$ and $—CH_2CH(CH_3)—O—$. The average number of bonds is preferably 100 to 200.

The compounds A may be used alone or in the form of a mixture of two or more of them.

Examples of the diepoxide compound as another starting material include the following compounds (1) to (10).

β,γ-epoxypropyl ether (1)

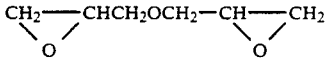

1,2-bis(β,γ-epoxypropoxy)ethane (2)

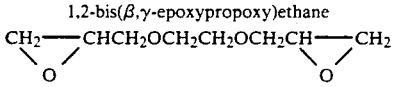

1,3-bis(β,γ-epoxypropoxy)propane (3)

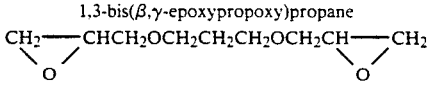

1,4-bis(β,γ-epoxypropoxy)butane (4)

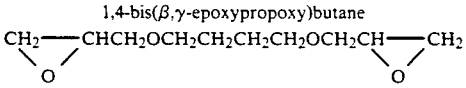

1,2-bis(β-methyl-β,γ-epoxypropoxy)ethane (5)

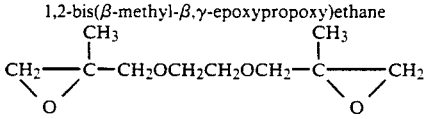

1,2-bis(α,β-epoxy-γ-methoxypropyl)ethane (6)

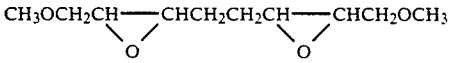

1,6-bis(epoxyethyl)hexane (7)

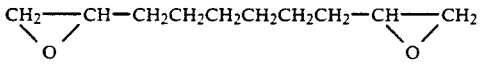

1,4-bis(β,γ-epoxypropoxy)benzene (8)

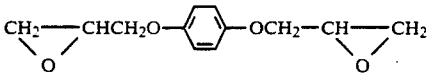

2,2-bis[p-(β,γ-epoxypropoxy)phenyl]propane (9)

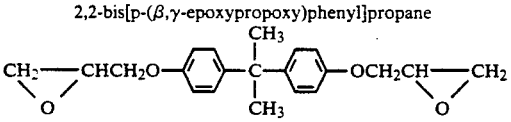

1-epoxyethyl-3,4-epoxycyclohexane (10)
(trivial name:vinylcyclohexene diepoxide)

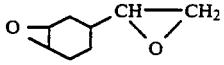

The diepoxide compounds may be used alone or in the form of a mixture of two or more of them.

The polyoxyalkylene derivative may be prepared by reacting the compound A with the diepoxide compound in the presence of an alkali catalyst. The ratio of the compound A to the diepoxide compound used in the reaction is properly selected depending upon the molecular weight of the compound A to be added and the kind of the diepoxide compound. However, in general, the epoxide compound is preferably 0.5 to 5 equivalents per equivalent of the hydroxyl group of the compound A. The reaction temperature is preferably 50° to 200° C., particularly preferably 100° to 150° C., and the reaction time is preferably 10 min to 10 hr, particularly preferably 30 min to 3 hr. Under these conditions, the reaction easily proceeds. As the reaction proceeds, the viscosity of the aqueous solution increases and finally reaches the maximum value. At this point, the reaction is regarded as completed (for details, see Japanese Patent Publication No. 32433/1970).

One of the surfactants may be used and a mixture of them may be used.

The dialkylamine oxide of the ingredients (b) used in the present invention shows high permeability by itself but shows less water solubility and, accordingly, the detergent power is not sufficient by itself. For the improvement of the solubility, it is necessary that the weight ratio of (a)/(b) is greater than 0.01. The dialkylamine oxide shows a strong permeability and improves the detergent power when it is incorporated only by a small amount into the detergent composition comprising the ingredient (a) as the main ingredient, but if the weight ratio (a)/(b) exceeds 100, the effect is undesirably reduced remarkably. Accordingly, it is necessary that the weight ratio (a)/(b) is within a range from 0.01 to 100, preferably, from 0.1 to 10.

The liquid detergent composition of the present invention can take various forms such as a liquid, paste, solid or powder; liquid or powder forms is desired in view of easy use.

The liquid detergent composition of the present invention is mainly used for cleaning of tablewares, cooking appliances or the washing of clothes and, in addition, it is also applicable as a detergent relevant to livings such as bath tub, bath room, floor, wall, window glass, furniture, toilet stool, etc. and there is no particular restriction for the application use. Various ingredients may be blended in addition to the essential ingredients described above to the liquid detergent composition according to the present invention within a range not deteriorating the aimed performance. They include an amphoteric surface active agent such as an alkyl betain and an alkyl sulfobetain. The solubilizing agent includes a lower alcohol such as ethanol and isopropanol; polyhydric alcohol such as ethylene glycol, propylene glycol, glycerine and sorbitol; and aromatic sulfonate such as p-toluene sulfonate and m-xylene sulfonate. Further, as the builder, there can be mentioned hard softener for clothes such as sodium sulfate, condensated phosphate, synthetic zeolite, ethylene diamine tetracetic acid (EDTA), nitrile triacetic acid (NTA), etc.; organic or inorganic alkali agents such as silicate, carbonate, sodium hydroxide and ethanolamine; recontamination inhibitor such as carboxymethyl cellulose and polyethylene glycol.

In addition, enzymes, abrasives, fluorescent dyes, pigments, preservers, perfumes, etc. may be blended depending on the purpose.

Figure 1:
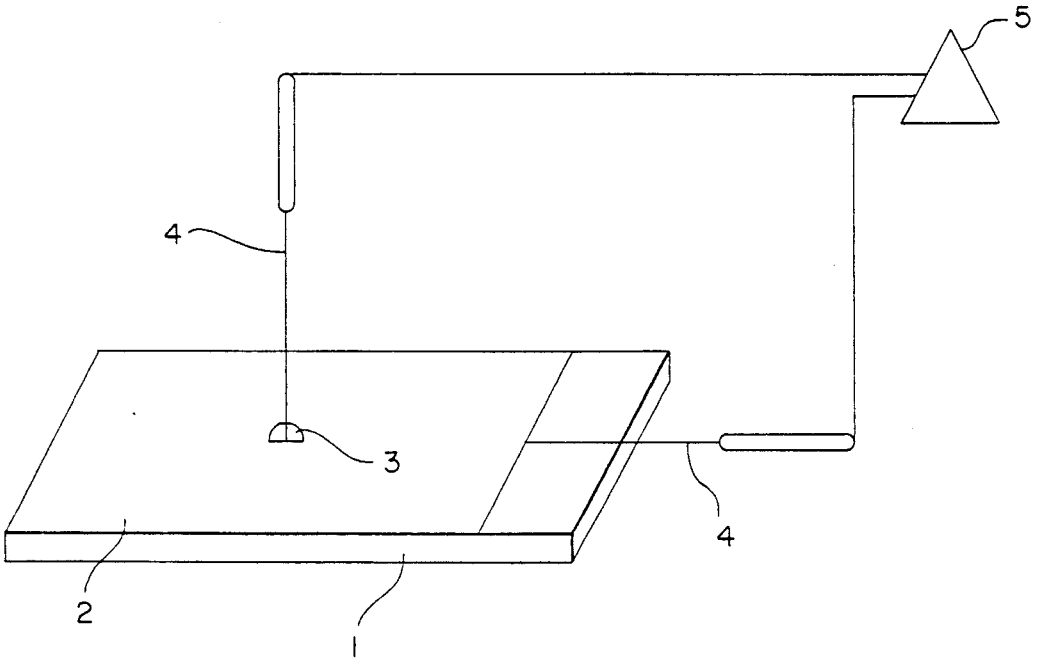
FIG. 1 is a schematic view for the device used for the permeability test in Example 1.

1 . . . Stainless steel plate
2 . . . Beef tallow-rape oil coated film
3 . . . Test solution droplet 4 . . . electrode 5 . . . oscilloscope The present invention will be described more in details by way of examples but the invention is not limited only to these examples.

EXAMPLE 1

Various types of compositions as shown in Table 1 were prepared and the permeability and the detergent power for each of them were examined by the following test methods.

Permeation Test (1)

Preparation of test specimen:

Model contaminations or soils prepared by mixing beef tallow and rape oil in a weight ratio of 9/1 were heated at a temperature being higher than their melting point, about 50 degree centigrade, and then uniformly coated on a stainless steel plate (15 cm×20 cm) by using a bar coater. In this case, the thickness of the model contaminations on the coated surface was adjusted to 20±3 um in a state where the plate was cooled to 25° C. and the oil is solidified.

An oscilloscope was connected to the specimen prepared as described above as shown in FIG. 1 and an aqueous solution of the detergent was dropped by 0.05 ml to the portion (3) shown in FIG. 1 and the time required for the aqueous solution of the detergent to penetrate through the oil layer and reach the stainless steel plate was measured under the following conditions.

| Measuring condition | |
|---|---|
| Concentration of the detergent | 0.15 wt % |
| Hardness of water used | 4° DH |
| Temperature | 25° C. |

Detergent Power Test (1)

The test was conducted according to JIS K3370-1979-4.9"Test method for the detergent power of kitchen synthetic detergent", under the following conditions.

| Measuring conditions | |
|---|---|
| Concentration of detergent | 0.15 wt % |
| Hardness of water used | 4° DH |
| Water temperature | 25° C. |
| Washing time | 10 min |
| Composition of model contaminations | Beef tallow/rape oil = 9/1 (weight ratio) |

Judgement for the Detergent Power

The cleaning rate was calculated based on the change of weight of the articles to be cleaned (slide glass) before and after cleaning.

The results are shown in Table 1.

TABLE 1

| | Invented product | | | | | Comparative product | | | | | | |
|---|---|---|---|---|---|---|---|---|---|---|---|---|
| | 1 | 2 | 3 | 4 | 5 | 1 | 2 | 3 | 4 | 5 | 6 | 7 |
| Ingredient (wt %) | | | | | | | | | | | | |
| Polyoxy ethylene (3) dodecyl ether sulfate Na | 15 | 10 | 10 | — | 5 | 25 | 15 | 15 | — | 10 | 25 | 0.2 |
| Linear alkyl benzene sulfonate Na (mean MW: 344) | — | 10 | — | — | — | — | 10 | — | — | — | — | — |
| α-sulfo fatty acid methyl ester Na (mean MW: 350) | — | — | 10 | — | — | — | — | 10 | — | — | — | — |
| α-olefin sulfonate Na (mean MW: 326) | — | — | — | 20 | — | — | — | — | 25 | — | — | — |
| Alkane sulfonate Na (mean MW: 356) | — | — | — | — | 15 | — | — | — | — | 15 | — | — |
| Di-octyl-polyoxyethylene (2) amine oxide*1 | 10 | 5 | 5 | 5 | 5 | — | — | — | — | — | 0.2 | 25 |
| Ethanol | 5 | 5 | 5 | 5 | 5 | 5 | 5 | 5 | 5 | 5 | 5 | 5 |
| Tap water | balance | balance | balance | balance | balance | balance | balance | balance | balance | balance | balance | balance |
| Item | | | | | | | | | | | | |
| Permeability (min) Permeability test (1) | 1.5 | 1 | 1.5 | 1.5 | 1.5 | 12 | 10 | 15 | 10 | 15 | 10 | 1.0 |
| Detergent (%) Detergent test (1) | 95 | 90 | 90 | 95 | 92 | 51 | 42 | 30 | 42 | 30 | 43 | 40 |

note

*1di-octyl-polyoxyethylene(2)amine oxide

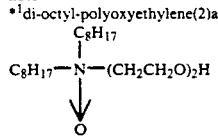

EXAMPLE 2

A composition as shown in Table 2 was prepared and the permeability and the detergent power were examined by the following test method.

The results are shown in Table 4

TABLE 2

| Ingredient | Blending ratio (wt %) |
|---|---|
| Linear alkyl benzene sulfonate Na (molecular weight 344) | 15 |
| Dodecyl sulfate Na | 10 |
| Dialkylamine oxide | 5 |
| Synthetic zeolite | 10 |
| Water content | 4 |
| Sodium sulfate | balance |

As the dialkylamine oxide, the compound represented by the general formula (I) in which $R_1$–$R_4$ and n are as shown in Table 4 were used.

Permeability Test (2)

An aqueous solution of the detergent was charged by 100 ml into a beaker of 100 ml volume and not-refined dry felt sized 2 cm×2 cm was gently placed on the surface of the solution and the time required for the felt to sink to the bottom of the beaker was measured under the following conditions.

| Measuring conditions | |
|---|---|
| Concentration of the detergent | 0.15 wt % |
| Hardness of water used | 4° DH |
| Water temperature | 25° C. |

Judgement for the Detergent Power

For detergent power, the reflectance of original cloth before applying contamination (carbon black was mixed as an indicator by ordinary method) and the contaminated cloth before and after the washing were measured by a self-recording color meter (manufactured by Shimazu Seisakusho) and the detergent factor was determined according to the equation shown below. Table 4 shows average measured values for 12 sheets of contaminated cloth.

Detergent factor (%) =

$$\frac{\text{Reflectance after washing} - \text{Reflectance before washing}}{\text{Reflectance of original cloth} - \text{Reflectance before washing}} \times 100$$

TABLE 4

| | | (b) Ingredient R and n in the general formula (I) | | | | | Permeability: Permeability test (2) | Detergent power: Detergent power test (2) |
|---|---|---|---|---|---|---|---|---|
| | | $R_1$ | $R_2$ | $R_3$ | $R_4$ | n | (sec) | (%) |
| Invention product | 6 | $C_6H_{13}$ | $C_6H_{13}$ | $CH_3$ $CH_2CH$ | H | 3 | less than 1 | 80 |
| | 7 | $C_3H_{17}$ | $C_3H_{17}$ | $CH_2CH_2$ | H | 2 | less than 1 | 88 |
| | 8 | $C_{10}H_{23}$ | $C_{10}H_{23}$ | $CH_2CH_2$ | H | 5 | less than 1 | 90 |
| | 9 | $C_{12}H_{25}$ | $C_{12}H_{25}$ | $CH_2CH_2$ | H | 8 | less than 1 | 81 |
| | 10 | $C_{18}H_{37}$ | $C_8H_{17}$ | $CH_2CH_2$ | H | 10 | less than 1 | 81 |
| | 11 | $C_8H_{17}$ | $C_8H_{17}$ | $CH_2CH_2$ | $CH_3$ | 3 | less than 1 | 85 |
| | 2 | $C_8H_{17}$ | $C_8H_{17}$ | $CH_2CH_2CH_2$ | H | 1 | less than 1 | 82 |
| Comparative product | 8 | with no addition of ingredient (b) | | | | | 28 | 58 |
| | 9 | $C_5H_{11}$ | $C_5H_{11}$ | $CH_2CH_2$ | H | 5 | 21 | 59 |
| | 10 | $C_{24}H_{49}$ | $C_8H_{17}$ | $CH_2CH_2$ | H | 22 | 30 | 45 |
| | 11 | $C_{12}H_{25}$ | $C_{12}H_{25}$ | — | $CH_3$ | 0 | 30 | 30 |

Detergent Power Test (2)

Artificially contaminated 12 sheets of cloth each sized 10 cm×10 cm and deposited with artificial (dirts) of a composition shown in Table 3 were placed in one liter of an aqueous solution of the detergent and not-contaminated clothes each of an identical size were further added such that the bath ratio 1/60 and they were washed by a Terg-O-to-meter under the conditions of less than 100 rpm.

| Measuring conditions | |
|---|---|
| Concentration of detergent | 0.15 wt % |
| Hardness of water used | 4° DH |
| Water temperature | 25° C. |
| Washing time | 10 min |
| Rinsing | 5 min with 4° DH hard water |

Composition of Artificial Dirts for Artificially Contaminated Cloth

TABLE 3

| Ingredient | Blending amount (wt %) |
|---|---|
| Cotton seed oil | 60 |
| Cholesterol | 10 |
| Oleic acid | 10 |
| Palmitic acid | 10 |
| Liquid and solid paraffin | 10 |

EXAMPLE 3

Detergent (A) (Comparative Product) and detergent (B) (Invented Product) shown in Table 5 were prepared and the permeability and the detergent power for each of them were examined. The permeability was evaluated in the same way as in the permeability test (2).

The results are shown in Table 5

Detergent Power Test (3)

Preparation of contaminated cloth;

White cotton/tetron mixed spun clothes were cut each into 9 cm×30 cm, attached to colors of a white shirts by sewing and put on by adult men for three days. After putting, the contaminated clothes were allowed to stand in a room at 25° C., 65% RH for one month. After standing, clothes contaminated similarly and also contaminated in a right to left symmetry relative to the center line were selected and the each of the clothes was bisected along the symmetry of the contaminations to be served for the measurement.

Washing of contaminated cloth:

One set of 15 sheets of contaminated clothes prepared as described above were attached by sewing to a cotton cloth of 50 cm×50 cm and a detergent composition used for evaluation was uniformly coated by 45 ml to the contaminated clothes. After allowing them to stand for 10 min, they were transferred together with cotton underwares by 1 kg in total into a washing machine "Ginga" manufactured by Toshiba Co. and tap water was added to make 30 liter in total. Then, they were washed at a water temperature of 25° C. in a strong reversing operation for 10 min and applied with storing and rinsing for 5 min over three times, dried and then served for the judgement of the detergent power.

Judgement for the Detergent Power

For the judgement of the detergent power, bisected clothes washed with two kind of detergent (A), (B) were evaluated by a paired comparison with naked eyes. The evaluation was made on the basis of standard contaminated clothes ranked by 10 steps representing the degree of the contamination.

The detergent power was expressed by the score (detergent index) of the detergent power of the detergent (B) assuming the detergent power of the detergent (A) as 100. The difference of the score by more than 0.5 was regarded as a meaningful difference.

TABLE 5

| | Comparative product Detergent (A) | Invented product Detergent (B) |
|---|---|---|
| Ingredient (wt %) | | |
| Polyoxyethylene (2.5) dodecyl ether sulfate Na | 25 | 25 |
| Dioctylpolyoxyethylene (5) amine oxide*2 | — | 3 |
| Diethanolamine | 5 | 5 |
| Ethanol | 5 | 5 |
| Tap Water | balance | balance |
| Item | | |
| Permeability (sec): Permeability Test (2) | 12 | less than 1 |
| Detergent power: | 100 | 104.2 |

TABLE 5-continued

| | Comparative product Detergent (A) | Invented product Detergent (B) |
|---|---|---|
| Detergent power test (3) | | |

Note:
*2dioctylpolyoxyethylene(5)amine oxide

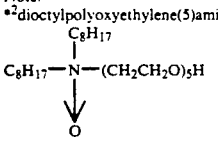

EXAMPLE 4

The compositions shown in Table 6 were prepared and examined in the same way as shown in Example 1. Table 6 shows test results.

EXAMPLE 5

The compositions shown in Table 7 and 8 were prepared and examined in the same way as shown in Example 2. Table 8 shows test results.

EXAMPLE 6

The detergents A' and B' were prepared and examined in the same way as shown in Example 3. Table 9 shows test results.

TABLE 7

| Ingredient | Blending ratio (wt %) |
|---|---|
| Polyoxyethylene(12) tetradecyl ether | 20 |
| dodecanoic acid monoethanolamide | 5 |
| Dialkylamine oxide | 5 |
| Ethanol | 5 |
| Tap water | balance |

TABLE 6

| | Composition of the present invention | | | | Comparative composition | | | | | |
|---|---|---|---|---|---|---|---|---|---|---|
| | 1 | 2 | 3 | 4 | 1 | 2 | 3 | 4 | 5 | 6 |
| Ingredient (wt %) | | | | | | | | | | |
| polyoxyethylene (8) dodecyl ether | 15 | — | 10 | — | 25 | — | 15 | — | 25 | 0.2 |
| polyoxyethylene (10) nonylphenyl ether | — | 20 | — | — | — | 25 | — | — | — | — |
| coconut oil fatty acid diethanolamide | — | — | 10 | — | — | — | 10 | — | — | — |
| polypropylene glycol-polyoxyethylene oxide adduct*1 | — | — | — | 20 | — | — | — | 25 | — | — |
| dioctylpolyoxyethylene (2) amine oxide*2 | 10 | 5 | 5 | 5 | — | — | — | — | 0.2 | 25 |
| ethanol | 5 | 5 | 5 | 5 | 5 | 5 | 5 | 5 | — | — |
| tap water | balance | balance | balance | balance | balance | balance | balance | balance | balance | balance |
| Test item | | | | | | | | | | |
| penetrating power (min) penetration test (1) | 1.5 | 1 | 1.5 | 1.5 | 15 | 12 | 10 | 15 | 10 | 1.0 |
| detergency (%) detergency test (1) | 95 | 90 | 90 | 95 | 40 | 51 | 42 | 30 | 42 | 40 |

Note:
*1Molecular weight of polypropylene glycol: 2000
Average molar number of addition of polyethylene oxide: 20
*2Dioctylpolyoxyethylene (2) amine oxide

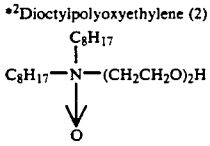

TABLE 8

| | Component (b) R and n in the general formula (I) | | | | | Penetrating power: penetration | Detergency: detergency |
|---|---|---|---|---|---|---|---|
| | $R_1$ | $R_2$ | $R_3$ | $R_4$ | n | test (2) (sec) | test (2) (%) |
| Product of the present invention | | | | | | | |
| 5 | $C_6H_{13}$ | $C_6H_{13}$ | $CH_3$ \| $CH_2CH$ | H | 3 | 1 or less | 80 |
| 6 | $C_8H_{17}$ | $C_8H_{17}$ | $CH_2CH_2$ | H | 2 | 1 or less | 90 |
| 7 | $C_{10}H_{23}$ | $C_{10}H_{23}$ | $CH_2CH_2$ | H | 5 | 1 or less | 88 |
| 8 | $C_{12}H_{25}$ | $C_{12}H_{25}$ | $CH_2CH_2$ | H | 8 | 1 or less | 85 |
| 9 | $C_{18}H_{37}$ | $C_8H_{17}$ | $CH_2CH_2$ | H | 10 | 1 or less | 81 |
| 10 | $C_8H_{17}$ | $C_8H_{17}$ | $CH_2CH_2$ | $CH_3$ | 3 | 1 or less | 85 |
| 11 | $C_8H_{17}$ | $C_8H_{17}$ | $CH_2CH_2CH_2$ | H | 1 | 1 or less | 85 |
| Comparative product | | | | | | | |
| 7 | component (b) not added | | | | | 30 | 50 |
| 8 | $C_5H_{11}$ | $C_5H_{11}$ | $CH_2CH_2$ | H | 5 | 15 | 52 |
| 9 | $C_{24}H_{49}$ | $C_8H_{17}$ | $CH_2CH_2$ | H | 22 | 35 | 45 |
| 10 | $C_{12}H_{25}$ | $C_{12}H_{25}$ | — | $CH_3$ | 0 | 30 | 30 |

TABLE 9

| | Comparative product detergent (A) | Product of the present invention detergent (B) |
|---|---|---|
| Component (wt %) | | |
| polyoxyethylene (7) dodecyl ether | 25 | 25 |
| dioctylpolyoxyethylene-(5) amine oxide*2 | — | 3 |
| diethanolamine | 5 | 5 |
| ethanol | 5 | 5 |
| tap water | balance | balance |
| Test item | | |
| penetrating power (sec) penetration test (2) | 15 | 1 or less |
| detergency detergency test (3) | 100 | 105.3 |

Note:
*2dioctylpolyoxyethylene (5) amine oxide

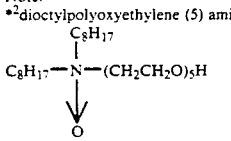

EXAMPLE 7

Detergent compositions for an automatic dish washer respectively having compositions specified in the following Table 10 were prepared, and the detergency was examined by the following testing methods. The results are given in Table 11.

Detergency Test

Beef tallow (according to the Pharmacopoeia of Japan) was melted in a warm bath at 80° C., applied in an amount of 5 g to a white porcelain dish having a diameter of 25 cm and left to stand for 24 hr in a thermostatic chamber at 25° C. to solidify the beef tallow. The stained dishes thus prepared were applied to a washing test in sets of four. The washing conditions and evaluation methods were as follows:

washing conditions apparatus used: automatic dish washer manufactured by Matsushita Electric Industrial Co., Ltd. (Model: NP-600)

washing temperature: 5° C. at the start of the washing, gradually raised during washing and finally raised to 55° C.

water used: 5 g of hard water having a hardness of 3.5° DH (concentration: about 0.2%)

washing time: washing for 20 min→rinsing for 20 min amount of circulating water during washing: about 2.5 l

Evaluation Method

An oil red solution was splashed on the dishes after washing and the reaction area ($S_1$) was measured photographically to calculate the percentage washing from an initial reaction area (So) by the following equation:

$$\text{percentage washing (\%)} = \frac{S_0 - S_1}{S_0} \times 100$$

The average percentage washing of the four dishes determined by the above equation was expressed based on the following evaluation criteria:

○: 100% : completely washed.

Δ: 80–90% : partially unwashed.

X: less than 80% not washed.

TABLE 10

| Ex. No. | Compound A | Diepoxy Compound | Equivalent ratio* |
|---|---|---|---|
| 1 | $C_{16}H_{33}O(CH_2CH_2O)_{100}H$ | 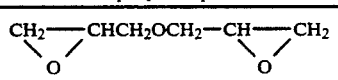 | 1 |
| 2 | | 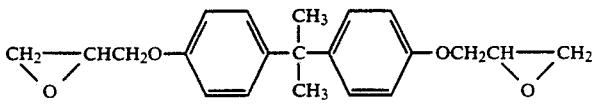 | 2 |

TABLE 10-continued

| Ex. No. | Compound A | Diepoxy Compound | Equivalent ratio* |
|---|---|---|---|
| 3 | | | |
| 4 | $C_{16}H_{33}O(CH_2CH_2O)_{50}H$ | 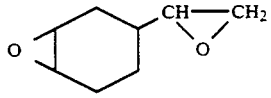 | 4 |
| 5 | $C_{16}H_{33}O(CH_2CH_2O)_{200}H$ | | |
| 6 | 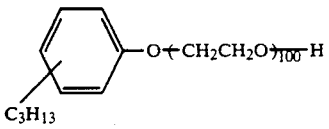 | | |
| 7 | $C_{18}H_{37}-S(CH_2\overset{CH_3}{\overset{\vert}{C}}HO)_{200}H$ | | |

Note:
Epoxy equivalent of diepoxy compound per equivalent of hydroxyl group of compound A.

TABLE 11

| | Product of the present invention | Comparative product | |
|---|---|---|---|
| | C | D | E |
| didecylpolyoxyethylene (5) amine oxide 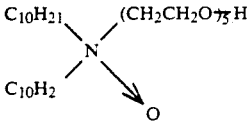 | 10 | 12 | — |
| polyoxyalkylene derivative (compound of Ex. 5) | 2 | — | 12 |
| trisodium citrate dihydrate | 10 | 10 | 10 |
| sodium carbonate | 20 | 20 | 20 |
| sodium sulfate | balance | balance | balance |
| detergency test | ○ | Δ | Δ |

Evaluation was conducted in the same manner as that described above, except that compound Nos. 1, 2, 3, 4, 6 and 7 were used instead of the polyalkylene derivative in the product C of the present invention. In all of the products, no stain remained on the four dishes after washing.

We claim:

1. A detergent composition which comprises (a) an anionic surfactant selected from the group consisting of an alkyl sulfate a polyoxyalkylene alkyl ether sulfate, an alkyl benzene sulfonate, an alpha-sulfo-fatty acid ester salt, an alphaolefin sulfonate and an alkane sulfonate; or a nonionic surfactant selected from the group consisting of a polyoxyalkylenealkylether, a polyoxyalkylenealkylphenylether, a higher fatty acid alkanolamide, an alkylglycoside, a polyethylene oxide adduct of polypropyleneglycol and a polyoxyethylene derivative prepared by reacting an alkylene oxide adduct of a monohydric alcohol, an alkylphenol or a monovalent mercaptan with a diepoxide compound; and (b) a dialkylamine oxide having the formula

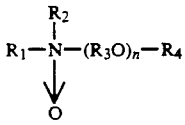

wherein $R_1$ and $R_2$ are each as alkyl having 6 to 18 carbon atoms, or an alkenyl having 6 to 18 carbon atoms, $R_3$ is ethylene, isopropylene, n-propylene or a mixture thereof, $R_4$ is an alkyl having 1 to 4 carbon atoms, hydroxy alkyl having 1 to 4 carbon atoms, benzyl or hydrogen, and n is 1 to 20, and wherein the weight ratio of (a) to (b) is in the range of from 0.1 to 10.

2. The composition as claimed in claim 1, wherein (a) is an anionic surfactant.

3. The composition as claimed in claim 1, wherein (a) is a nonionic surfactant.

4. The composition as claimed in claim 1, which is in the form of a liquid, paste, solid or powder.

5. The composition as claimed in claim 1, which further comprises an amphoteric surfactant.

6. The composition as claimed in claim 1, which further comprises a solubilizing agent, a builder, a water-softener, an alkali or a re-contamination inhibitor.

* * * * *